US005251683A

United States Patent [19]

Backer

[11] Patent Number: 5,251,683

[45] Date of Patent: Oct. 12, 1993

[54] METHOD OF MAKING A CYLINDER HEAD OR OTHER ARTICLE WITH CAST IN-SITU CERAMIC TUBES

[75] Inventor: Gerald P. Backer, Southfield, Mich.

[73] Assignee: General Motors Corporation, Detroit, Mich.

[21] Appl. No.: 667,922

[22] Filed: Mar. 11, 1991

[51] Int. Cl.[5] ..... B22D 19/00

[52] U.S. Cl. ..... 164/98; 164/11; 164/112; 164/76.1

[58] Field of Search ..... 164/91, 98, 112, 11, 164/28, 30, 31, 465, 76.1

[56] References Cited

U.S. PATENT DOCUMENTS

| | | | |
|---|---|---|---|
| 3,173,451 | 3/1965 | Slayter | 164/98 |
| 3,568,723 | 3/1971 | Sowards | 164/98 |
| 3,825,055 | 7/1974 | Mino et al. | 164/132 |
| 3,919,755 | 11/1975 | Kaneko et al. | 29/156.4 |
| 4,003,422 | 1/1977 | Schramm et al. | 164/9 |
| 4,148,352 | 4/1979 | Sensui et al. | 164/112 |
| 4,346,556 | 8/1982 | Rice et al. | 60/272 |
| 4,637,110 | 1/1987 | Yamagata | 29/156.4 |
| 4,828,009 | 5/1989 | Taniguchi | 164/98 |
| 4,840,219 | 6/1989 | Foreman | 164/369 |
| 4,849,266 | 7/1989 | Dwivedi | 29/527.3 |
| 4,938,802 | 7/1990 | Noll | 164/364 |
| 4,997,024 | 3/1991 | Cole | 164/98 |
| 5,012,853 | 5/1991 | Bihlmaier | 164/98 |

FOREIGN PATENT DOCUMENTS

| | | | |
|---|---|---|---|
| 58-37277 | 8/1983 | Japan | 164/91 |
| 60-216967 | 10/1985 | Japan | 164/98 |

*Primary Examiner*—Mark Rosenbaum
*Assistant Examiner*—Rex E. Pelto
*Attorney, Agent, or Firm*—George A. Grove

[57] ABSTRACT

A method is disclosed for making an article, such as a cylinder head, having one or more hollow ceramic tubes, such as ceramic exhaust port liners, cast in-situ therein with reduced cracking or breakage of the ceramic tube from tensile and compressive stresses exerted on the ceramic tube during the casting process. The method involves forming a removable core in the ceramic tube of a core material having a thermal expansion coefficient not exceeding about 10 times that of the ceramic tube to minimize crack-causing differential thermal expansion-induced tensile stresses on the ceramic tube when molten metal is cast therearound, casting the molten metal about the cored ceramic tube in a mold cavity, stress relieving the cast article at an elevated temperature before the cast article cools to a lower temperature at which crack-causing differential thermal contraction-induced compressive stresses are exerted on the cast in-situ ceramic tube, and removing the core from the cast article.

13 Claims, 3 Drawing Sheets

METHOD OF MAKING A CYLINDER HEAD OR OTHER ARTICLE WITH CAST IN-SITU CERAMIC TUBES

FIELD OF THE INVENTION

The present invention relates to a method of casting an article, such as a cylinder head, having one or more hollow ceramic tubes, such as exhaust port liners, cast in-situ therein in such a manner as to reduce breakage of the tubes from tensile and compressive stresses exerted on the tubes during the casting process.

BACKGROUND OF THE INVENTION

It is known to use ceramic exhaust port liners in the exhaust channels of cylinder heads for internal combustion engines, especially for engines equipped with a turbocharger. The exhaust port liners minimize loss of heat from the exhaust gases and thereby provide the turbocharger with hotter gases to enhance its operation.

It is also known to line exhaust manifolds, pipes and mufflers with a ceramic liner to retain the high temperature of the exhaust gases longer for improved secondary combustion of potentially polluting hydrocarbons present in the exhaust gases.

A typical approach to the manufacture of products such as cylinder heads and exhaust manifolds having ceramic liners therein has involved fabricating a hollow liner of a suitable ceramic material, filling the hollow liner with a mixture of foundry sand (e.g., silica sand) and a resin or other binder which cures or hardens to form a bonded core in the liner, placing one or more of the cored liners in a mold cavity of a casting mold (e.g., a permanent mold or a sand mold), casting molten iron or aluminum into the mold cavity about the cored liners, removing the casting from the mold after the molten metal solidifies and then removing the bonded cores from inside the cast in-situ ceramic liner by suitable mechanical or chemical means. A product, such as a cylinder head or exhaust manifold, is thereby cast with one or more ceramic liners cast in-situ therein.

When this approach has been applied to the manufacture of cylinder heads having cast in-situ ceramic exhaust port liners, the ceramic liners have been observed to be susceptible to cracking during the casting process as a result of differential thermal expansion differences between the ceramic liner and the bonded core formed therein. In particular, when molten metal is cast about the cored exhaust port liner, the liner and core can be heated to a sufficiently high temperature that tensile stresses are exerted on the liner by the bonded core which expands at a greater rate. This thermal cracking problem is exacerbated by the brittleness, low tensile strength and low thermal expansion coefficient of the ceramic materials used to make the exhaust port liners.

The degree of susceptibility of the ceramic liner to cracking depends on the configuration of the liner, the design of the cylinder head cast therearound as well as the process used to cast the cylinder head. Configurational and design modifications of the exhaust port liners can sometimes be made to lessen or reduce their susceptability to cracking, but these modifications typically increase the cost and the complexity of the liners.

It is an object of the invention to provide a method of making cylinder heads with ceramic exhaust port liners cast in-situ therein wherein differential thermal expansion/contraction stress-induced breakage or cracking of the ceramic exhaust port liners is reduced or minimized regardless of the type (configuration) of the liners employed.

SUMMARY OF THE INVENTION

The invention contemplates a method of making an article, such as a cylinder head, having one or more hollow, ceramic tubes, such as tubular exhaust port liners, cast in-situ therein comprising (a) forming a removable core in the ceramic tube of a core material having a thermal expansion coefficient not exceeding 10 times the thermal expansion coefficient of the ceramic tube whereby cracking of the ceramic tube from differential thermal expansion-induced tensile stresses is minimized when molten metal is cast around the ceramic tube and core, (b) casting molten metal about the ceramic tube in an article-shaped mold cavity to form a solidified, cast article with the ceramic tube cast in-situ therein, (c) subjecting the cast article to an elevated temperature stress-relieving treatment before the cast article cools to a lower temperature at which harmful, crack-causing differential thermal contraction-induced compressive stresses are exerted on the cast in-situ ceramic tube, and (d) removing the core from the cast in-situ ceramic tube.

In one embodiment of the invention, the core comprises a shaped mixture of the core material and a thermally decomposable binder, and the casting mold comprises a shaped mixture of a mold material and a thermally decomposable binder of the same or different type as the core binder. The stress-relieving treatment is conducted with the cast article remaining in the casting mold so that the core binder and the mold binder thermally decompose to facilitate subsequent removal of the core material and the mold material from the cast article.

A typical working embodiment of the invention involves making a cast iron cylinder head having a plurality of ceramic exhaust port liners cast in-situ therein. Preferably, the exhaust port liners comprise aluminum titanate and the core formed in each aluminum titanate liner comprises a cured/hardened mixture of zircon particulate and a thermally decomposable resin binder. The zircon particulate core exhibits a thermal expansion coefficient less than five times the thermal expansion coefficient of the aluminum titanate liners to minimize cracking of the liners as a result of differential thermal expansion stresses between the liners and cores when the molten iron is cast therearound. After the molten iron is cast and solidified around the cored liners, the cast cylinder head is stress relieved in the casting mold at a temperature greater than about 1050° F., preferably greater than about 1100° F., for a sufficient time to minimize cracking ceramic liners during subsequent cooling of the cast cylinder head to ambient temperature. Typically, the cast cylinder head is subjected to the stress-relieving treatment before its temperature falls below about 500° F.

The method of the invention permits the casting of articles, such as cylinder heads, having one or more hollow ceramic tubes cast in-situ therein with substantially reduced cracking or breakage of the ceramic tube as a result of both tensile and compressive stresses exerted on the ceramic tubes during the casting process. The method of the invention lowers the susceptibility of various configurations of ceramic tubes to cracking or breakage as they are cast in-situ in the article and renders a wider range of configurations, preferably simpler, lower cost configurations, of ceramic tubes usable in the manufacture of such articles.

The invention may be better understood when considered in light of the following detailed description of certain specific embodiments thereof which is given hereafter in conjunction with the following drawings.

BEST MODE OF PRACTICING THE INVENTION

Although the method of the invention is described in detail hereinbelow with respect to making a cylinder head having a plurality of hollow ceramic exhaust port liners cast in-situ therein, those skilled in the art will appreciate that the method has wider applicability and is useful in making myriad articles having one or more hollow ceramic tubes cast in-situ therein.

Figure 4:
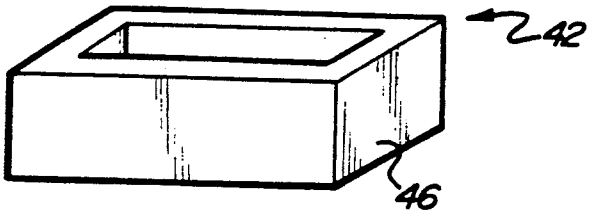
FIG. 4 is a fragmentary sectional view of the casting mold showing the cored exhaust port liner positioned in the mold cavity.
Figure 4:
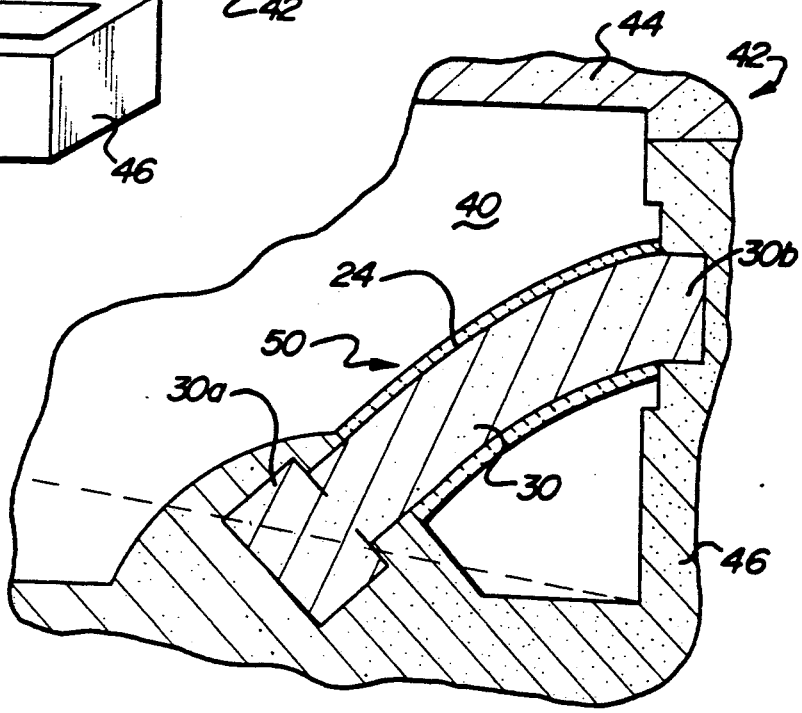
Figure 5:
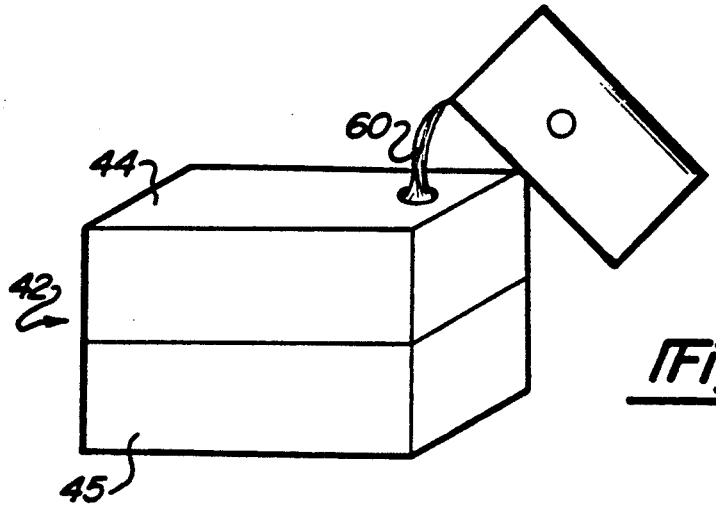
FIG. 5 is a schematic perspective view showing molten metal being poured into the casting mold.
Figure 6:
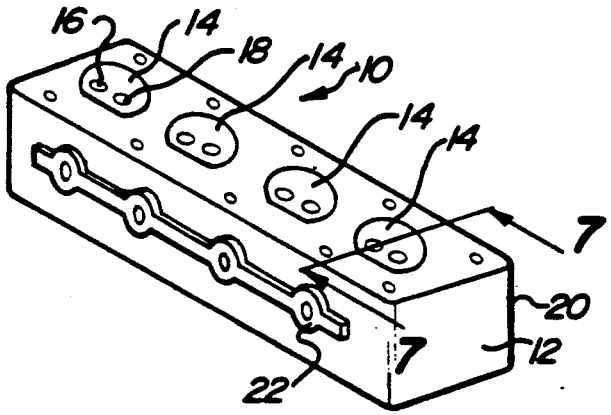
FIG. 6 is a perspective view of a cast cylinder head made by practicing the invention.
Figure 7:
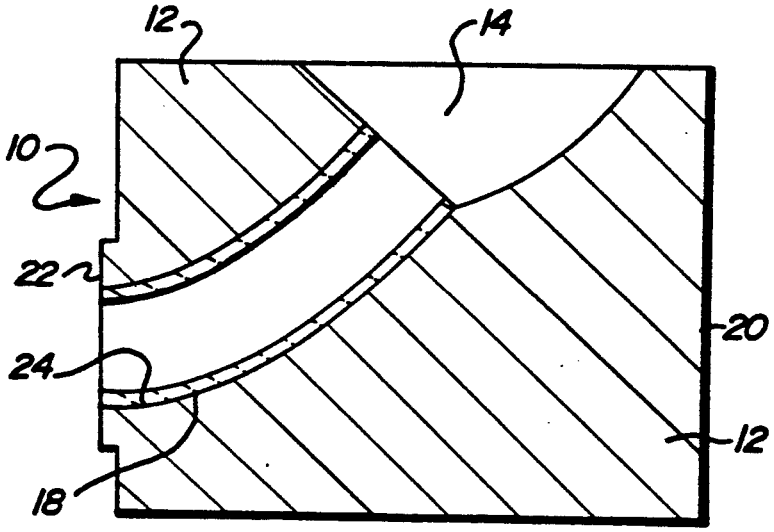
FIG. 7 is a fragmentary sectional view of the cast cylinder head showing one exhaust port liner cast in-situ therein.

The method of the present invention is illustrated in FIGS. 1 through 5 for making the cast cylinder head 10 shown in FIGS. 6 through 7. The cylinder head 10 comprises a cast iron, aluminum or other metal body 12 having a plurality (four shown) of concave cylinder domes 14 cast therein with each dome 14 including an inlet port 16 and an outlet (exhaust) port 18. Each inlet port 16 extends through the cast body 12 to an intake manifold-engaging surface 20. Each exhaust port 18 extends through the cast body 12 to an exhaust manifold-engaging surface 22 where the usual exhaust manifold (not shown) is attached.

Figure 1:
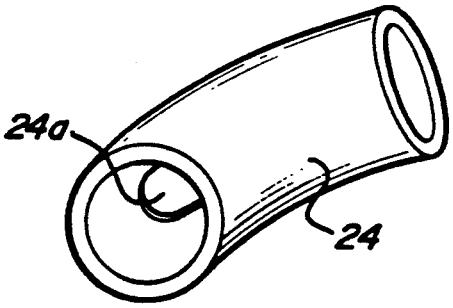
FIG. 1 is a perspective view of a hollow exhaust port liner for use in practicing the invention.
Figure 2:
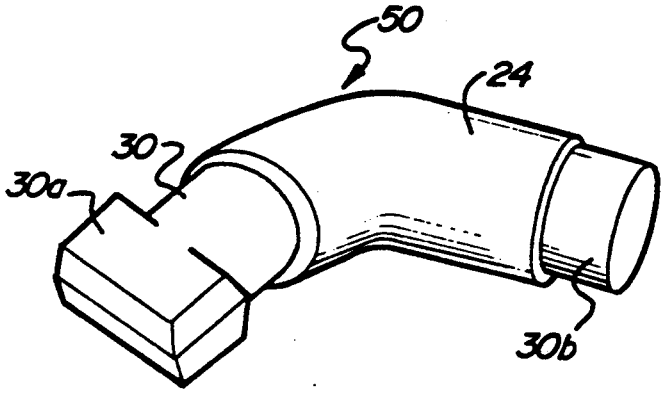
FIG. 2 is a perspective view of the exhaust port liner having a removable sand core formed therein.
Figure 3:
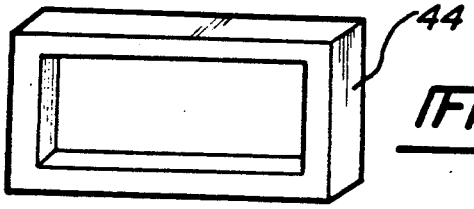
FIG. 3 is a schematic perspective view of a casting mold for use in practicing the invention.

A hollow ceramic exhaust port liner 24 is cast in-situ in the body 12 to form and extend through each exhaust port 18. A typical hollow ceramic exhaust port liner 24 is shown in FIG. 1 prior to being cast in-situ in the cylinder head 10. Each liner 24 may include a slot 24*a* to accommodate exhaust valving of the cylinder head.

The exhaust port liners 24 are fabricated from a suitable ceramic material, such as cordierite, alumina, zirconia, aluminum titanate, beta-spodumene and fused silica, which exhibits low density, low specific heat and a low thermal conductivity. Of these, aluminum titanate is most preferred as a result of its relatively high strength in compression and relatively high elastic modulus that together yield a high strain to failure in compression for this particular material.

The exhaust port liners 24 are shown in FIGS. 1, 2, 4 and 7 as having an approximate circular cross-section and a gradual bend so as to extend through the exhaust port 18 to the exhaust manifold-engaging surface 22. The cross-sectional shape and bend of the exhaust port liners 24 can be varied to accommodate different cylinder head designs as well as to lessen stresses imposed on the liners 24 during manufacture of the cylinder head.

In accordance with the method of the invention for manufacturing the cylinder head 10, each exhaust port liner 24 is first filled with a mixture of ceramic core material and a thermally decomposable binder which is curable and/or hardenable to form a bonded core 30 in each liner 24. Typically, the mixture of core material and binder is cured and/or hardened in each liner 24 in a core mold (not shown) to form shaped core ends 30*a*,30*b* exposed outside each liner 24. As is known, the shaped core ends 30*a*,30*b* are used to support the exhaust port liners 24 in desired position in the mold cavity 40 of a casting mold 42, FIGS. 3 and 4.

Importantly, the core material is selected to exhibit a thermal expansion coefficient that does not exceed 10 times, preferably does not exceed 5 times, the thermal expansion coefficient of the ceramic exhaust port liners 24 such that thermal stresses exerted on the liners 24 are maintained at a level to minimize breakage or cracking of the liners when the liners 24 and their cores 30 are heated during casting of the cylinder head 10 therearound in the casting mold 42.

For purposes of illustration only, when the exhaust port liners 24 are made of the preferred ceramic material, i.e., aluminum titanate having a thermal expansion coefficient of 1.0 micro inch/inch/° C., the core material will comprise zircon particulate (preferably 140 mesh size) having a thermal expansion coefficient of 4.0 micro inch/inch/° C. Although the zircon particulate of the cores 30 has a higher thermal expansion coefficient than that of the aluminum titanate liners 24, the difference between the thermal expansion coefficient is small enough that differential thermal expansion stresses exerted on the liners 24 during casting (where the liners 24 and the cores 30 reach temperatures on the order of 600° F. in casting aluminum and 1200° F. in casting nodular iron) are insufficient to cause stress-induced cracks or breakage of the liners 24 during that phase (casting phase) of the manufacturing process. Thus, the thermal expansion coefficient of the ceramic cores 30 is regarded as being compatible with that of the ceramic liners 24.

As mentioned hereinabove, the ceramic core material is mixed with a resin or other binder that cures and/or hardens to bond the zircon particulate into the desired core shape. Preferably, the binder is selected to be thermally decomposable at a stress-relieving temperature to which the cast cylinder head 10 is subsequently subjected as explained hereinbelow. Since the stress-relieving temperature used will depend on the particular metal 60 used to cast the cylinder head 10, the particular resin binder employed will also depend on the metal being cast.

For purposes of illustration, when the core material comprises zircon particulate and the molten metal 60 being cast is nodular iron, the resin binder will comprise an organic oil-urethane resin curable in air over a given time period or an organic phenolic/urethane/amine resin (catalyzed by a catalyzing gas drawn through the mixture), both of which thermally decompose at temperatures above about 600° F. When the molten metal being cast is aluminum using the same core material (zircon particulate) for cores 30, the resin binder will comprise an organic polyol/urethane (which sets or cures in air) that thermally decomposes at a temperature above about 400° F. By thermally decomposes it is meant that the binder is vaporized or otherwise loses its capability to securely bond the zircon particles together.

The oil/urethane binder for use in casting iron is a no-bake type comprising an alkyd resin, polymeric isocyanate and lead salt catalyst. The phenolic/urethane/amine binder is a cold box type comprising phenolic resin, polymeric isocyanate and tertiary amine (gas). The polyol/urethane binder for use in casting aluminum is a no-bake type comprising polyether polyol and polymeric isocyanate.

Other organic or inorganic binders of the known cold box, hot box and no-bake types may be used in practicing the invention, although organic binders are preferred as a result of their thermal decomposability. These known binder types are set forth in a technical article entitled "Updating Resin Binder Processes", Parts I-IX published in Foundry m & T, 1986, and authored by P. Carey and G. Sturtz.

As shown best in FIG. 4, each cored liner 50 (i.e., exhaust port liner 24 with the removable, thermal decomposable cores 30 formed therein) is positioned in the mold cavity 40 of the casting mold 42 in usual fashion with the core ends 30*a*,30*b* functioning as locators and supports for each cored liner 50 in the mold cavity. The mold cavity 40 is configured in the shape of the cylinder head 10 to be cast and may include other cores (not shown) positioned therein to form coolant passages, oil passages and the like typically present in the cast cylinder head 10.

Once the cored liners 50 and the other cores (not shown) are properly positioned in the mold cavity 40, the mold cope 44 and the mold drag 46 are engaged, FIG. 5. The cope 44 and drag 46 are made of a mixture of foundry sand (silica sand) and a thermally decomposable binder, preferably the same binder as used in the cores 30. Molten metal 60 is poured into the mold cavity 40 about the cored liners 50 and other cores (not shown) therein. The molten metal 60 solidifies in the mold cavity 40 to form the cast cylinder head 10 having the cored liners 50 and other cores cast in-situ therein.

In accordance with the method of the invention, the cylinder head 10 is subjected to a stress-relieving treatment after the molten metal solidifies but before it can cool to a lower temperature at which harmful, cracking-causing compressive stresses are exerted on the cast in-situ cored liners 50 as a result of differential thermal contraction of the cooling metal around the cored liners 50. When the cylinder head 10 is cast of nodular iron, the cast cylinder head must not be allowed to cool below a temperature of about 500° F. before stress relieving the cast cylinder head 10. On the other hand, for a cast aluminum cylinder head, the cylinder head must not be allowed to cool below about 300° F. without subjecting the cylinder head to the stress-relieving treatment.

The stress-relieving treatment for a cast nodular iron cylinder head involves subjecting the cylinder head to a temperature of greater than about 1050° F., preferably greater than about 1100° F., for a sufficient time to reduce internal stresses in the cylinder head to avoid differential thermal contraction cracking-causing stresses on the liners 24 during subsequent cooling to ambient temperature. For a cast aluminum cylinder head, a stress-relieving temperature greater than about 575° F., preferably greater than about 600° F., has been used. Times on the order of four hours have proved adequate for stress relieving cast nodular iron and aluminum cylinder heads having the aforementioned cored aluminum titanate liners 50 cast in-situ therein.

Preferably, the cast cylinder head 10 is stress relieved in the casting mold 42 not only to stress relieve the cast cylinder head but also to thermally decompose the binder of the cores 30 and the cope 44 and drag 46 to facilitate subsequent removal of the core material and mold material from the cast cylinder head 10. The stress-relieving treatment is effected by placing the casting mold 42 in a suitable furnace (not shown) before the cylinder head cools below the critical temperature (500° F. for iron and 300° F. for aluminum) and heating the cylinder head to subject it to the desired stress-relieving temperature for the desired time.

Following the stress-relieving treatment, the cast cylinder head 10 is cooled to ambient temperature outside the furnace. Then, the cylinder head is removed from the casting mold 42 and the thermally decomposed cores 30 are removed from the cast in-situ liners 24 by mechanical means, such as blasting air.

Since the core binder is thermally decomposed during the stress-relieving treatment, the cores 30 are easily removed and cleaned out of the cast in-situ liners 24. Likewise, the cope 44 and drag 46 are also easily removed from the cast cylinder head as a result of the mold binder being thermally decomposed during the stress-relieving treatment.

The cast cylinder head 10 is then subjected to final machining operations prior to assembly with other cylinder head components such as valves, valve guides, cam shafts, etc.

Figure 8:
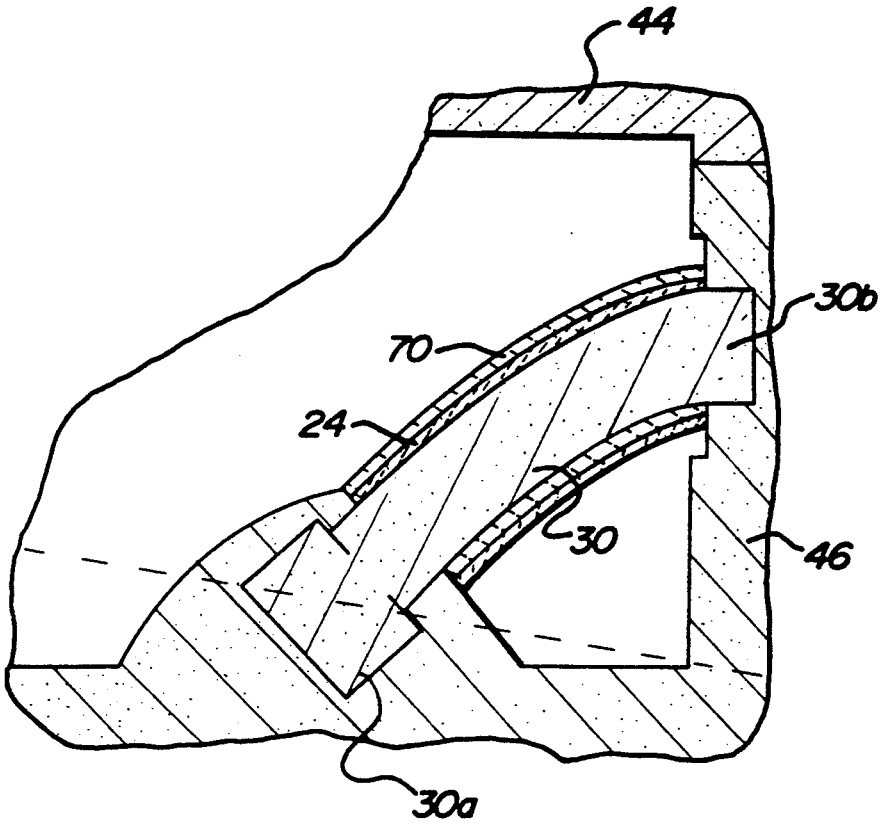
FIG. 8 is a view similar to FIG. 4 of another embodiment of the invention where the exhaust port liner is coated with a ceramic layer.

The method of the invention envisions coating the exterior surfaces of the liners 24 with a ceramic coating 70, FIG. 8, to further reduce differential thermal contraction stresses exerted on the liners during cooling of the cylinder head 10 cast therearound. The liners 24 are typically coated by dipping in a slurry of a mica-based ceramic or graphite. Coating thicknesses between about 0.5 mm and 2 mm have been used. The mica-based coating or graphite coating both have higher strain to failure in compression than the aforementioned aluminum titanate liners 24. As a result, the coating 70 is compressed by the differential thermal contraction forces exerted by the cooling cylinder head 10 around the cast in-situ cored liners 50 and thereby reduces compressive stresses exerted on the liners 24 as the cylinder head 10 cools.

The method of the invention provides an economical, low cost method for casting cylinder heads with cast in-situ ceramic exhaust port liners with much reduced cracking or breakage of the liners during the casting process. Moreover, the cores 30 in the exhaust port liners 24 and the mold 42 are readily removed following casting by virtue of the core binder and mold binder being thermally decomposed during the stress-relieving treatment carried in the casting mold 42.

While the invention has been described in terms of specific preferred embodiments thereof, it is not intended to be limited thereto but rather only to the extent set forth hereafter in the appended claims.

The embodiments of the invention in which an exclusive property or privilege is claimed are defined as follows:

1. A method of making a cast iron article comprising a tubular passage with a cast-in place ceramic tube lining the passage, comprising:

(a) forming a removable core in the ceramic tube of a core material having a thermal expansion coefficient not exceeding about 10 times the thermal expansion coefficient of the ceramic tube so as to minimize cracking of the ceramic tube from differential thermal expansion-induced tensile stresses when molten iron is cast about the ceramic tube, (b) casting molten iron about the cored ceramic tube positioned in an article-shaped mold cavity to form a solidified, cast article with the ceramic tube cast in-situ therein, (c) subjecting the cast iron article and ceramic tube to an elevated temperature stress-relieving treatment before the cast iron article cools below about 500° F., and (d) removing the core from the cast in-situ ceramic tube.

2. The method of claim 1 including making the core of said core material and a thermally decomposable core binder.

3. The method of claim 2 including forming the mold cavity by shaping a mixture of molding material and a thermally decomposable mold binder.

4. The method of claim 1 wherein the step of stress relieving the cast iron article in the mold cavity as in step (c) occurs at a temperature greater than about 1050° F.

5. The method of claim 1 wherein the core material exhibits a thermal expansion coefficient not exceeding about five times the thermal expansion coefficient of the ceramic tube.

6. The method of claim 5 wherein the core material is zircon particulate.

7. A method of making a cast iron cylinder head having a hollow ceramic exhaust port liner cast in-situ therein, comprising:

(a) forming a removable core in the ceramic exhaust port liner of a core material having a thermal expansion coefficient not exceeding about 10 times the thermal expansion coefficient of the ceramic exhaust port liner so as to minimize cracking thereof from differential thermal expansion-induced tensile stresses when molten metal is subsequently cast about the ceramic exhaust port liner, (b) casting molten iron about the cored ceramic exhaust port liner in a cylinder head-shaped mold cavity to form a solidified, cast iron cylinder head with the ceramic exhaust port liner cast in-situ therein, (c) subjecting the cast iron cylinder head to a stress-relieving treatment at a temperature of greater than about 1050° F. before the cast cylinder head cools below about 500° F., and (d) removing the core from the cast in-situ exhaust port liner after the cast cylinder head is stress relieved.

8. The method of claim 7 wherein the ceramic exhaust port liner comprises aluminum titanate.

9. The method of claim 7 or 8 wherein the core material comprises zircon particulate.

10. The method of claim 7 including making the core of said core material and a thermally decomposable core binder.

11. The method of claim 10 including forming the mold cavity by shaping a mixture of molding material and a thermally decomposable mold binder.

12. The method of claim 11 including stress relieving the cylinder head in the mold cavity to thermally decompose the core binder and mold binder in step (c) to facilitate removal of the core and mold material in step (d).

13. The method of claim 7 wherein the cast cylinder head is stress relieved at a temperature greater than about 1100° F.

* * * * *